US011741858B2

(12) United States Patent
Riggs

(10) Patent No.: US 11,741,858 B2
(45) Date of Patent: Aug. 29, 2023

(54) FENCE AND GATE DECORATIVE COVER

(71) Applicant: Darline Riggs, Miramar, FL (US)

(72) Inventor: Darline Riggs, Miramar, FL (US)

( * ) Notice: Subject to any disclaimer, the term of this patent is extended or adjusted under 35 U.S.C. 154(b) by 0 days.

(21) Appl. No.: 17/718,837

(22) Filed: Apr. 12, 2022

(65) Prior Publication Data

US 2023/0196948 A1 Jun. 22, 2023

Related U.S. Application Data

(60) Provisional application No. 63/290,202, filed on Dec. 16, 2021.

(51) Int. Cl.
*G09F 7/18* (2006.01)
*E04H 17/00* (2006.01)

(52) U.S. Cl.
CPC ..... *G09F 7/18* (2013.01); *E04H 17/00* (2013.01); *G09F 2007/1856* (2013.01)

(58) Field of Classification Search
CPC ..... E04H 17/00; E04H 17/1426; A01K 3/00; G09F 2007/1856; G09F 7/18
See application file for complete search history.

(56) References Cited

U.S. PATENT DOCUMENTS 4,890,403 A * 1/1990 Dinan ..... G09F 15/0037 40/604
5,402,988 A * 4/1995 Eisele ..... A63B 71/022 256/73
D423,615 S * 4/2000 Wiedner ..... D21/781
6,719,276 B1 * 4/2004 Bush ..... G09F 15/0006 40/606.03
7,117,619 B1 * 10/2006 Huber ..... A63B 71/0672 40/604
7,198,835 B2 * 4/2007 Anderson ..... A47H 99/00 52/311.1
7,997,560 B2 * 8/2011 Bergdoll ..... E04H 17/066 256/67
8,732,999 B1 * 5/2014 Hughes ..... G09F 15/0018 160/329
10,410,553 B2 * 9/2019 Holyfield ..... G09F 17/00
10,550,634 B1 * 2/2020 Holland ..... E06B 9/06
2013/0095273 A1 * 4/2013 Rinaudo ..... G09F 7/18 40/299.01
2017/0284048 A1 * 10/2017 Ortega ..... B01D 17/08
2018/0171701 A1 * 6/2018 Huang ..... E04H 15/58

* cited by examiner

*Primary Examiner* — David R Dunn
*Assistant Examiner* — Christopher E Veraa
(74) *Attorney, Agent, or Firm* — Brennan, Manna & Diamond, LLC

(57) ABSTRACT

The present invention relates to a decorative and removable cover for wrapping and protecting fences and gates. The cover is made of weatherproof, durable, tear resistant, and decorative material. More specifically, the cover includes a front covering member and a rear covering member for covering the fence from opposing sides. The covering members can be coupled/sewn at one or more edges or can be independent of each other. The cover includes a plurality of extension bands that are used for securing the cover onto the fence. The cover extends generally between the posts and between the top rail and the bottom rail of the fence. Users apply the cover as a temporary modification to the fence or gate which is in accordance with rules of homeowners' associations. The cover comes in a variety of sizes, colors, themes, and designs.

6 Claims, 5 Drawing Sheets

FENCE AND GATE DECORATIVE COVER

CROSS-REFERENCE TO RELATED APPLICATION

The present application claims priority to, and the benefit of, U.S. Provisional Application No. 63/290,202, which was filed on Dec. 16, 2021 and is incorporated herein by reference in its entirety.

FIELD OF THE INVENTION

The present invention relates generally to fence and gate covers. More specifically, the present invention relates to a novel fence cover for a fence portion (i.e. picket fence), chain link fence, driveway gate, yard fence gate, and more. The cover is made from weatherproof and tear resistant material and is secured to posts of the fence using a plurality of elastic bands extending out from edges of the cover. The cover is removable and engages with posts and rails of the fence or gate for covering the fence/gate. Additionally, the fence/gate cover can be manufactured in different styles and themes to fit a desired aesthetic, party, occasion or more. Accordingly, the present disclosure makes specific reference thereto. Nonetheless, it is to be appreciated that aspects of the present invention are also equally applicable to other like applications, devices, and methods of manufacture.

BACKGROUND

By way of background, fences and gates are usually constructed outdoors to maintain a boundary of a property of a homeowner and to separate their yard from a neighbor. The fence is a structure that is usually constructed from posts that are connected by boards, wire, rails, chain link, or netting. The conventional fence and gates can be chain link or picket fencing that may look unattractive and boring to the homeowners. In cases of theme parties or events that are organized outdoors and where theme-based decorations are used to create an exciting environment, unadorned traditional gates or fences can diminish the look of the organized event, thereby leaving the homeowner unhappy. These unadorned fences and gates can be ugly and unattractive, but individuals may be unable to modify them due to potential homeowner association violations.

Some individuals may desire to replace the entire fence with a more decorative and attractive option; however, it can be quite expensive and may not be affordable by all individuals. Further, the fence replacement is a time-consuming task and requires experts to properly replace the fence. Furthermore, replacing the complete fence with a newer fence/gate is a permanent solution that may not suit the theme of any particular party or event organized in the yard. Also, changing the fence frequently to fit a desired aesthetic is not a desired option for the homeowners.

Therefore, there exists a long-felt need in the art for an accessory for fences and gates that can be used to enhance the look and style of the conventional fences and gates. There is also a long-felt need in the art for a covering for fences and gates that can accommodate fences and gates of different sizes and shapes. Additionally, there is a long-felt need in the art for a fence cover that can be easily applied on the fences by the homeowners without the need of hiring experts. Moreover, there is a long-felt need in the art for a fence/gate accessory that can be used to quickly change the look of fence to suit the themes of different events, parties, holidays and more. Further, there is a long-felt need in the art for a fence/gate accessory that eliminates the need to replace the complete fence to change its look, and therefore saves the money and effort of homeowners. Furthermore, there is a long-felt need in the art for a fence/gate cover that eliminates the need to make permanent modifications and provides temporary solutions to the homeowners as per their desires. There is a long-felt need in the art for a fence/gate covering that changes the look of fence without violating Home Owner's Association (HOA) terms and agreements. Finally, there is a long-felt need in the art for a fence covering that is easy to use and is affordable by all individuals.

The subject matter disclosed and claimed herein, in one embodiment thereof, comprises a removable fence portion cover or gate cover. The fence cover is made of a flexible, stretchy material for covering the fence and/or gate and obviates the need to make permanent modifications to a fence or gate. The fence cover comprising a front covering member and a rear covering member; said covering members are configured to position on opposing sides of the fence for completely covering the fence; said covering members having a top edge to position along a top rail of the fence, a bottom edge to position along a bottom rail of the fence, and a pair of longitudinal edges positioned near the posts of the fence; a plurality of elastic bands extended from said longitudinal edges wherein the elastic bands are sewn to the covering members; the covering members are configured to be individually and separately applied to the fence and are secured to the posts of the fence by tying a knot of each elastic band along the post to cover the fence.

In this manner, the fence cover of the present invention accomplishes all of the forgoing objectives and provides users with a removable fence cover that can be used to enhance the look and style of the conventional fences and gates without violating HOA terms and agreements. The cover temporarily and easily wraps the fence and/or cover and eliminates the need to replace the complete fence to change its look, and therefore saves the money and effort of homeowners. The cover provides a themed background on fences for a variety of occasions including, but not limited to, birthday parties, anniversaries, holidays, and numerous other outdoor events.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a removable fence/gate cover. The fence cover comprising a front covering member and a rear covering member; said covering members are configured to position on opposing sides of the fence/gate; said covering members having a top edge to position along a top rail of the fence/gate, a bottom edge to position along a bottom rail of the fence/gate and a pair of longitudinal edges; a plurality of elastic bands extended from said longitudinal edges wherein the elastic bands are sewn to the covering members; the covering members are configured to be individually and separately applied to the fence/gate and are secured to the posts of the fence/gate by tying a knot of each elastic band along the post to cover the fence/gate.

In yet another embodiment, the front covering member has a design disposed thereon.

In yet another embodiment, the rear covering member has a same or a different design than the design disposed on the front covering member.

In yet another embodiment, the fence cover is waterproof and tear resistant.

In yet another embodiment, the fence cover is removable and adheres to homeowner association rules.

In yet another embodiment, the front covering member and the rear covering member are coupled to each other along a common top edge.

In yet another embodiment, a method for covering fences and gates using a flexible and decorative fitted cover is described. The method includes the steps of providing the fitted cover, the cover comprising of at least one covering panel for covering at least a portion of the fence/gate, the covering panel having a design thereon, the covering panel includes a pair of longitudinal edges with a plurality of elastic bands extending therefrom; wrapping a portion of the fence/gate by the cover; and securing the cover by tying the elastic bands to the posts of the fence/gate.

In yet another embodiment, the method further includes removing the cover from the fence/gate when the cover is not required.

In yet another embodiment, a fence with a complimentary fence cover is disclosed. The fence includes a plurality of slats positioned between a pair of posts, a top rail, and a bottom rail; the removable fence cover is configured to wrap around the fence for covering the fence. The fence cover extends between the posts and between the top rail and the bottom rail such that a plurality of elastic bands is used for securing the cover by tying the knots of the elastic bands around the posts.

In yet another embodiment, the fence/gate cover is made from stretchable, flexible, weatherproof, and tear resistant material.

In yet another embodiment, the elastic bands are made from elastic nylon.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
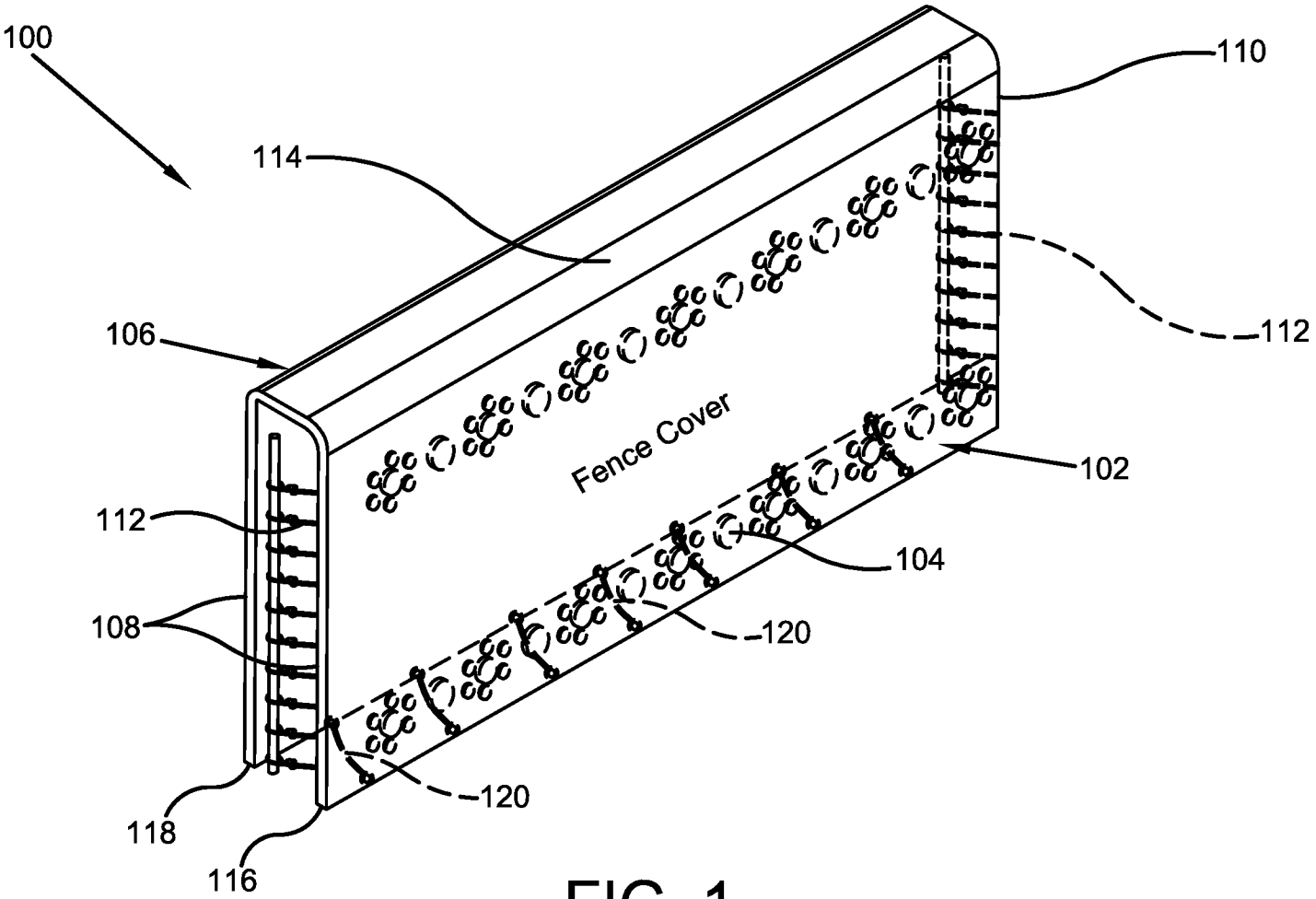
FIG. 1 illustrates a perspective view of one potential embodiment of the themed fitted cover of the present invention in an unfolded state prior to being applied on a fence portion in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an accessory for fences and gates that can be used to enhance the look and style of the conventional fences and gates. There is also a long-felt need in the art for a covering for fences and gates that can accommodate fences and gates of different sizes and shapes. Additionally, there is a long-felt need in the art for a fence/gate cover that can be easily applied on the fences/gates by homeowners without the need of hiring experts. Moreover, there is a long-felt need in the art for a fence/gate accessory that can be used to quickly change the look of fences/gates to suit the themes of different events, parties, holidays and more. Further, there is a long-felt need in the art for a fence/gate accessory that eliminates the need to replace the complete fence/gate to change its look, and therefore saves the money and effort of the homeowners. Furthermore, there is a long-felt need in the art for a fence/gate cover that eliminates the need to make permanent modifications and provides temporary solutions to the homeowners as per their desires. There is a long-felt need in the art for a fence/gate covering that changes the look of fences/gates without violating Home Owner's Association (HOA) terms and agreements. Finally, there is a long-felt need in the art for a fence/gate covering that is easy to use and is affordable by all individuals.

The present invention, in one exemplary embodiment, is a novel fence/gate cover. A fence portion can include a plurality of slats or pickets positioned between a pair of posts, a top rail, and a bottom rail; the removable fence cover is configured to wrap around or over a top rail and tops of chain links and/or tops of pickets for covering the fence portion. The fence cover extends generally between the posts and between the top rail and the bottom rail such that a plurality of elastic bands can be used for securing the cover by tying the knots of the elastic bands around the posts or by tying the knots of the elastic bands through the chain links.

The cover can be stretched to completely wrap the fence portion from both sides and extended between the rails and the posts.

Referring initially to the drawings, FIG. 1 illustrates a perspective view of one potential embodiment of the themed fitted cover of the present invention prior to being applied to a fence portion in accordance with the disclosed architecture. The themed fitted cover 100 of the present invention is designed as a flexible fitted cover for covering unsightly fence portions and gates. The cover 100 is flexible, weatherproof and can come in a variety of colors and designs. The cover 100 eliminates the need to make permanent modifications to a fence or gate which can be expensive and may violate homeowner association rules.

Figure 2:
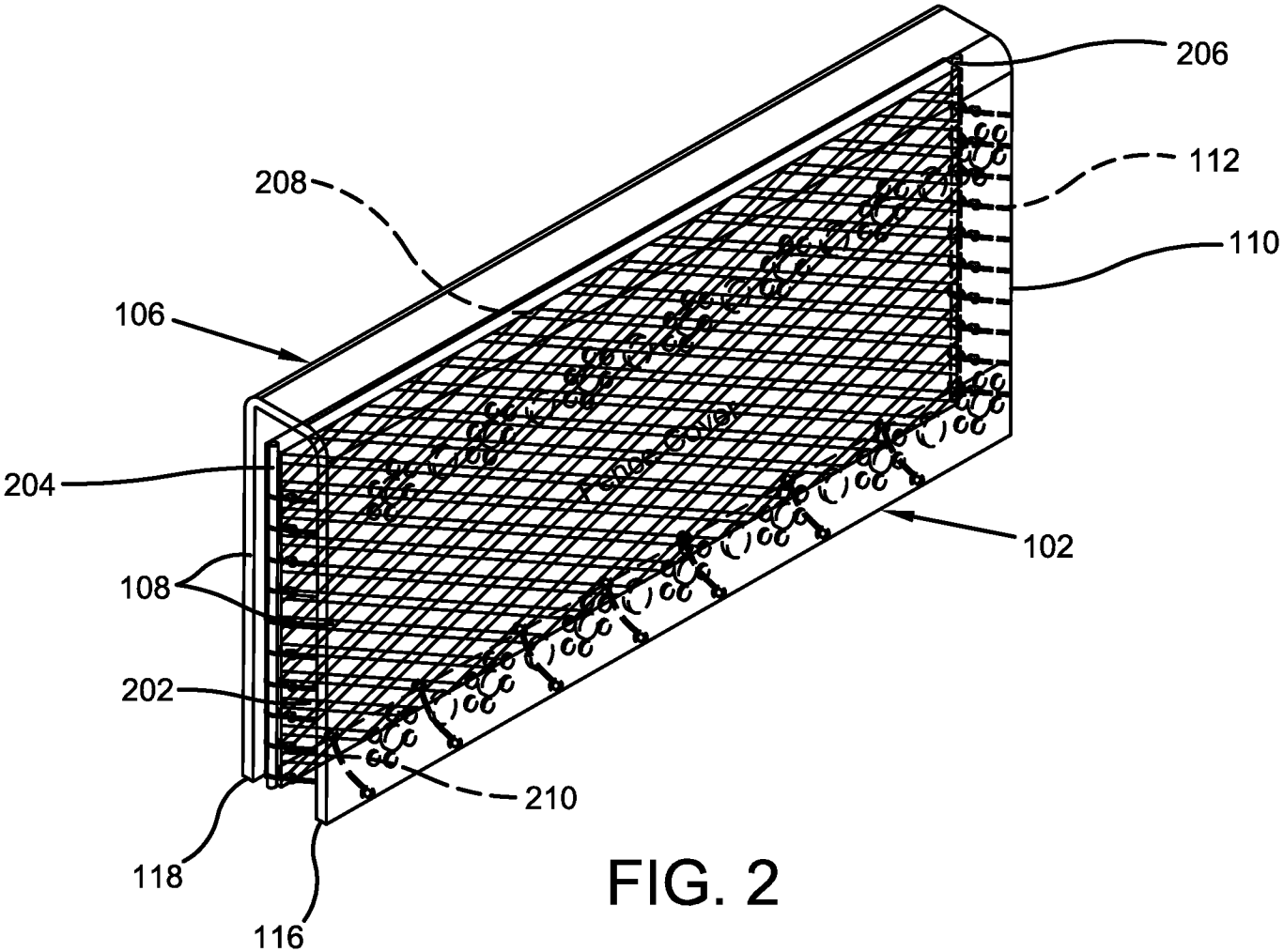
FIG. 2 illustrates a perspective view of the themed fitted cover of FIG. 1 being applied to a fence portion in accordance with the disclosed architecture.

More specifically, the cover 100 is generally rectilinear, rectangular, or square and is dimensioned to cover a portion of a conventional picket fence, chain link fence, or any other type of fence or gate. The cover 100 includes a front covering member 102 having a design 104 thereon and a rear covering member 106 that can be plain or can have the same or a different design. The front covering member 102 and the rear covering member 106 are configured to cover opposing sides of a fence portion or gate. Each of the covering members 102,106 includes two longitudinal edges 108,110 and a plurality of elastic bands 112 extending from the longitudinal edges 108,110. The elastic bands 112 are used for securing the cover 100 to one or more posts of the fence and specifically, the bands 112 can be tied to the posts by making knots as illustrated in FIG. 2. A common top edge 114 of the covering members 102,106 is configured to position along or over the top edge of the top rail of the fence and bottom edges 116,118 are configured to position proximal to opposing sides of the bottom edge of the bottom rail of the fence portion. The bottom edges 116,118 can include bands 120 therebetween for securing the covering members 102,106 on opposing sides of, for example, a chain link fence thereby enabling a user to wrap a fence portion by securing the cover 100 from the bottom edges 116,118. It should be noted that the covering members 102,106 can be separate and independent (as illustrated in FIG. 4) enabling a user to separately secure the covering members 102,106 to cover opposing sides of a fence portion as per their desire and preference.

The covering members 102,106 can have a plurality of folding lines (not shown) positioned and spaced apart between the two longitudinal edges 108,110. The cover 100 of the present embodiment is configured to cover the fence portion from both sides, however, any one of the covering members 102,106 can be removed to cover the fence portion from only one side.

FIG. 2 illustrates a perspective view of the themed fitted cover of FIG. 1 being applied to a fence portion in accordance with the disclosed architecture. As illustrated, the front covering member 102 and the rear covering member 106 are applied to opposing sides of an exemplary chain link fence portion 202 for covering the fence portion 202. The fence portion 202 can extend from the first post 204 to the second post 206 and includes a top rail 208 and a bottom rail 210. The length of the covering members 102,106 extending between the longitudinal edges 108,110 and is dimensioned as per a length of the fence portion 202 such that the elastic bands 112 are secured to the posts 204,206 by tying knots. Alternatively, the elastic bands can be tied to the chain links.

Figure 4:
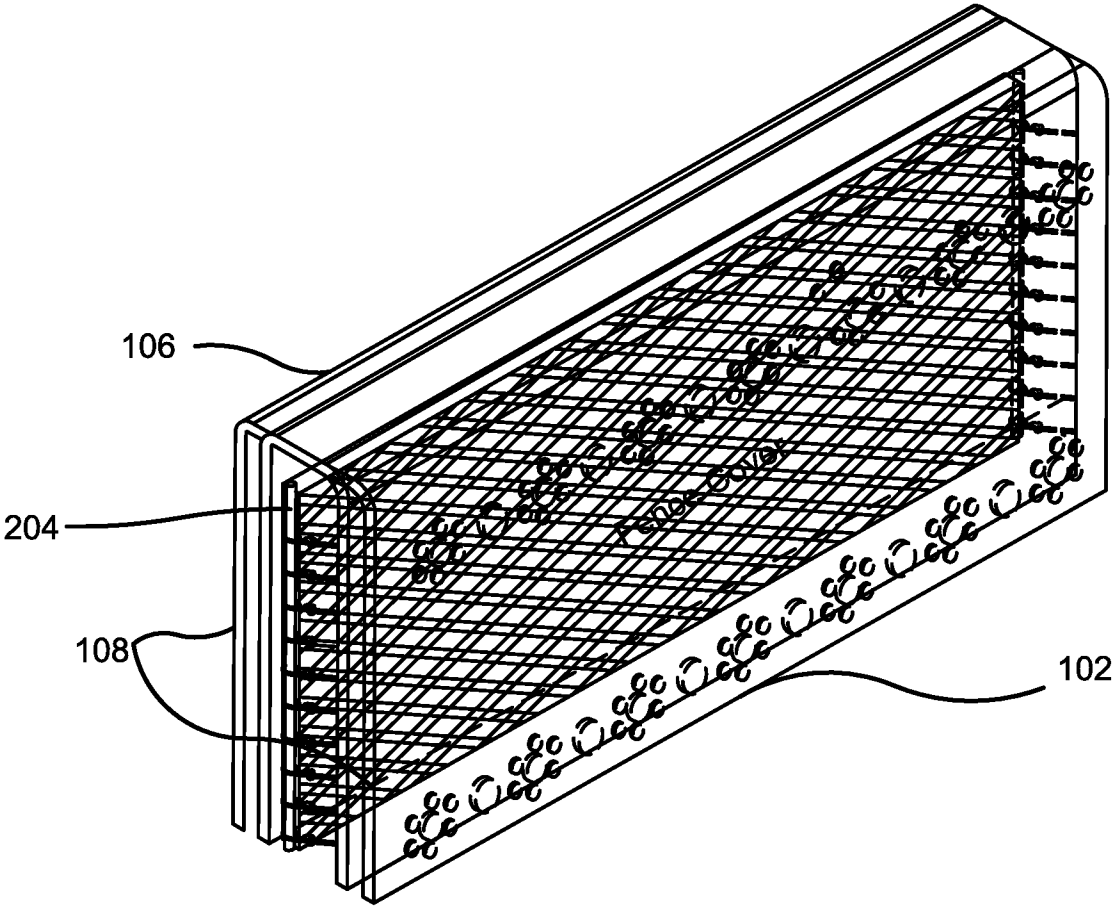
FIG. 4 illustrates a perspective view of the themed fitted cover of FIG. 1 being applied to a fence portion with the covering members as separate members in accordance with the disclosed architecture.

The covering members 102,106 can be separately placed on opposing sides of the fence portion 202 (as illustrated in FIG. 4) or can be placed over the fence portion 202 using the open bottom edges 116,118 (when the members 102,106 have a common top edge as illustrated in the present embodiment) and thereby protecting and covering the fence portion 202. The top edge 114 is positioned along the top rail 208 and the bottom edges 116,118 are positioned proximal to the bottom rail 210 of the fence portion 202.

It should be noted that design 104 positioned on the covering members 102,106 is visible from outside and therefore, the fence portion 202 is decorated using the custom designs disposed on the covering members 102,106.

Figure 3:
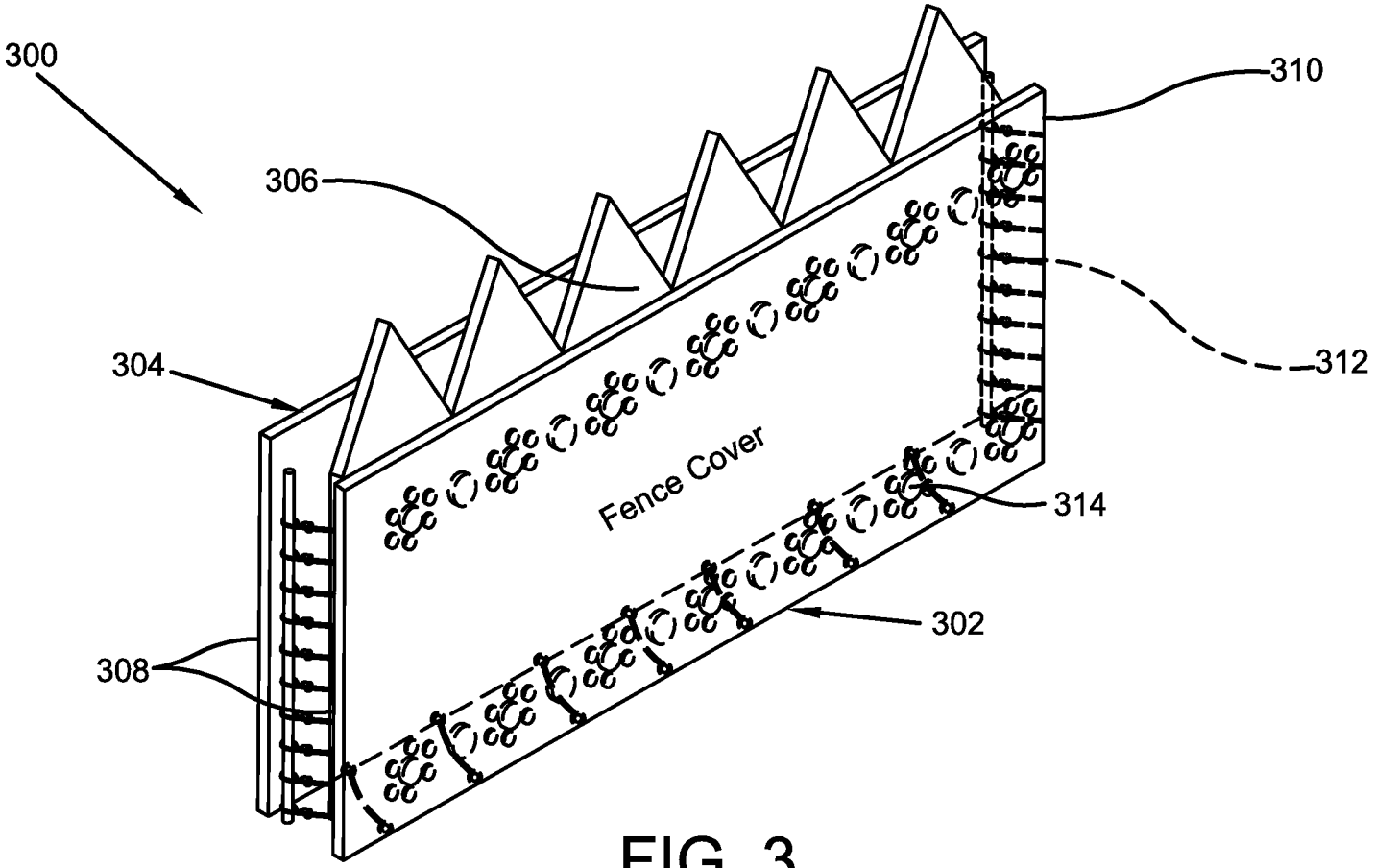
FIG. 3 illustrates a perspective view of another potential embodiment of the themed fitted cover of the present invention in an unfolded state prior to being applied on a fence portion in accordance with the disclosed architecture.

FIG. 3 illustrates a perspective view of another potential embodiment of the themed fitted cover of the present invention prior to being applied on a fence portion or gate in accordance with the disclosed architecture. The themed fitted cover 300 of the present invention is especially designed for picket fence portions having a plurality of pickets positioned between a pair of posts. The cover 300 is open ended from three sides and includes a closed top edge. More specifically, the cover 300 includes a front covering surface 302 and a rear covering surface 304 having a common top edge 306 and a design 314. The top edge 306 includes a shape substantially conforming to a top of a conventional picket fence portion and can be one or more of pointed, round, straight, or other. It is to be appreciated that the top edge 306 can conform to the picket width, picket spacing, and picket geometry (refer to FIG. 5). The longitudinal edges 308,310 include extension/elastic bands 312 that enable the extension bands 312 to be fastened to the posts of the picket fence.

Although, in the present embodiment, the covering surfaces 302,304 have a common sewn top edge 306, alternatively, the covering surfaces 302,304 can be independent and separate and can be separately secured using the extension/elastic bands 312.

FIG. 4 illustrates a perspective view of the themed fitted cover of FIG. 1 being applied to a fence portion with the covering members as separate members in accordance with the disclosed architecture. As illustrated, the covering members 102,106 in the present embodiment do not have a common top edge and can be used individually or in combination for wrapping the fence portion along one side or both sides.

Figure 5:
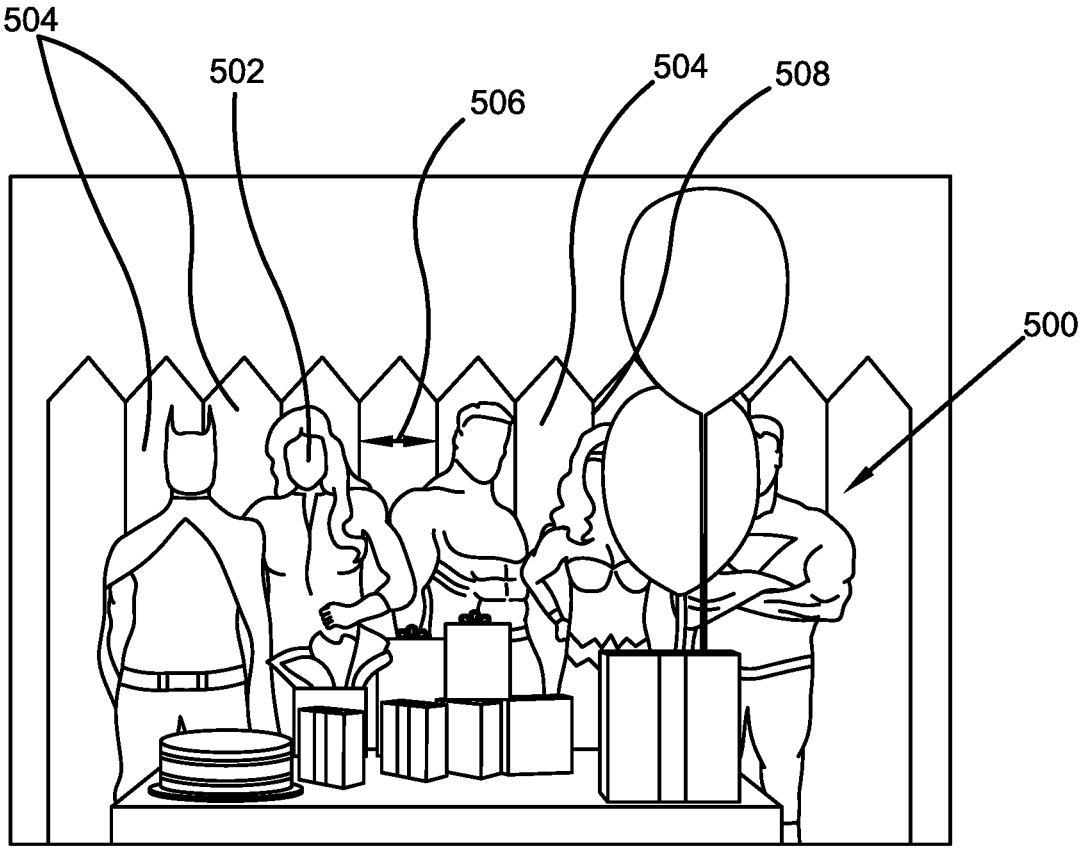
FIG. 5 illustrates a front perspective view of an exemplary fence cover of the present invention having superhero design as a theme in accordance with the disclosed architecture.

FIG. 5 illustrates a front perspective view of an exemplary fence cover of the present invention having a superhero design as a theme in accordance with the disclosed architecture. As illustrated, for a birthday celebration in a backyard, the fence cover 500 can have a design having a plurality of superhero images 502. As illustrated, the fence is shown as a picket fence including a plurality of pickets 504. Each picket 504 includes a picket width 506 and adjacent pickets 504 include a picket spacing 508 therebetween. It should be appreciated that there is no limit to the design and colors that can be used to decorate the fence covers of various embodiments of the present invention.

The cover of various embodiments of the present invention includes a variety of colors, styles, and decorative designs that can be used for standard use, birthday parties, holidays, and numerous other outdoor events. Any of conventional manufacturing and printing techniques can be implemented to manufacture the fence/gate cover. The cover eliminates the requirement to permanently modify the fence and is therefore cost effective, quick, and easy to implement. The fence covering members can be separately formed and subsequently joined along one or more edges.

In use, the cover envelops all the rails of a portion of fencing and fits onto the fence. Accordingly, the fence cover can be sized to extend around any number of rails, size, and length of fencing.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "themed fitted cover", "fence cover", "cover", "decorative fence portion cover" and "removable fence portion cover" are interchangeable and refer to the decorative fence portion cover 100,300,500 of the present invention.

Notwithstanding the forgoing, the decorative fence/gate cover 100,300,500 of the present invention can be of any suitable size and configuration as is known in the art without affecting the overall concept of the invention, provided that it accomplishes the above stated objectives. One of ordinary skill in the art will appreciate that the decorative fence/gate cover 100,300,500 as shown in the FIGS. are for illustrative purposes only, and that many other sizes and shapes of the decorative fence/gate cover 100,300,500 are well within the scope of the present disclosure. Although the dimensions of the decorative fence/gate cover 100,300,500 are important design parameters for user convenience, the decorative fence/gate cover 100,300,500 can be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fence portion cover for displaying an image, the fence portion cover comprising:

a front covering member having a first design thereon and covering a front side of the fence portion;

a rear covering member covering an opposing rear side of the fence portion;

a top edge of said fence portion cover connecting said front covering member and said rear covering member, wherein said top edge of said fence portion cover is positioned over a top edge of the fence portion;

wherein said front covering member and said rear covering member include longitudinal edges, wherein said longitudinal edges include a plurality of elastic bands mounted thereto;

wherein said elastic bands extend from said longitudinal edges for securing to the fence portion;

wherein securing to the fence portion includes securing said elastic bands to a first fence post at a first end of the fence portion and securing said elastic bands to a second fence post at a second end of the fence portion;

wherein said top edge of said fence portion cover includes a non-linear edge conforming to the top edge of the fence portion, and the top edge of the fence portion is a top edge of a picket fence portion; and further wherein said top edge of said fence portion cover conforming to a picket width and a picket spacing of the picket fence portion.

2. The fence portion cover of claim 1, wherein securing to the fence portion includes securing said elastic bands to chain links of the fence portion.

3. The fence portion cover of claim 2, wherein the fence portion is a gate.

4. A fence portion cover for displaying an image, the fence portion cover comprising:

a front covering member having a first design thereon and covering a front side of the fence portion;

a rear covering member covering an opposing rear side of the fence portion;

a top edge of said fence portion cover connecting said front covering member and said rear covering member, wherein said top edge of said fence portion cover positioned over a top edge of the fence portion;

wherein said front covering member includes a front bottom edge and said rear covering member includes a rear bottom edge;

wherein said front bottom edge and said rear bottom edge include a plurality of elastic bands mounted thereto;

wherein said elastic bands extend between said front bottom edge and said rear bottom edge for securing to the fence portion;

wherein said top edge of said fence portion cover includes a non-linear edge conforming to the top edge of the fence portion, and the top edge of the fence portion is a top edge of a picket fence portion; and further wherein said top edge of said fence portion cover conforming to a picket width and a picket spacing of the picket fence portion.

5. The fence portion cover of claim 4, wherein securing to the fence portion includes securing said elastic bands to chain links of the fence portion.

6. The fence portion cover of claim 4, wherein the fence portion is a gate.

* * * * *